US011262104B2

(12) United States Patent
Uraguchi et al.

(10) Patent No.: US 11,262,104 B2
(45) Date of Patent: Mar. 1, 2022

(54) UNIT DEVICE OF REFRIGERATION CYCLE APPARATUS

(71) Applicant: Mitsubishi Electric Corporation, Tokyo (JP)

(72) Inventors: Shogo Uraguchi, Tokyo (JP); Yasuyuki Kotake, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 105 days.

(21) Appl. No.: 16/498,923

(22) PCT Filed: May 22, 2017

(86) PCT No.: PCT/JP2017/018965

§ 371 (c)(1),
(2) Date: Sep. 27, 2019

(87) PCT Pub. No.: WO2018/216052

PCT Pub. Date: Nov. 29, 2018

(65) Prior Publication Data

US 2020/0072508 A1 Mar. 5, 2020

(51) Int. Cl.

| | |
|---|---|
| ***F25B 1/00*** | (2006.01) |
| ***F25B 49/02*** | (2006.01) |
| ***F24F 11/89*** | (2018.01) |
| ***F24F 11/36*** | (2018.01) |
| ***F24F 13/22*** | (2006.01) |

(52) U.S. Cl.

CPC ..... *F25B 1/00* (2013.01); *F25B 49/02* (2013.01); *F24F 11/36* (2018.01); *F24F 11/89* (2018.01); *F24F 13/22* (2013.01); *F25B 2500/222* (2013.01)

(58) Field of Classification Search

CPC .. F24F 11/36; F24F 11/89; F24F 13/22; F25B 1/00; F25B 2500/222; F25B 49/02

See application file for complete search history.

(56) References Cited

U.S. PATENT DOCUMENTS

2002/0178738 A1* 12/2002 Taira ..... F24F 11/30 62/129
2011/0277541 A1* 11/2011 Kadle ..... B60H 1/00978 73/40.7

FOREIGN PATENT DOCUMENTS

| | | | |
|---|---|---|---|
| JP | 2002-098346 | A | 4/2002 |
| JP | 2003-137320 | A | 5/2003 |
| JP | 2012-026695 | A | 2/2012 |
| JP | 2014-081160 | A | 5/2014 |
| JP | 2015-224837 | A | 12/2015 |

(Continued)

OTHER PUBLICATIONS

International Search Report of the International Searching Authority dated Aug. 8, 2017 for the corresponding International application No. PCT/JP2017/018965 (and English translation).

(Continued)

*Primary Examiner* — Henry T Crenshaw
(74) *Attorney, Agent, or Firm* — Posz Law Group, PLC

(57) ABSTRACT

A unit device of a refrigeration cycle apparatus forms part of a refrigerant circuit using flammable or slightly flammable refrigerant. The unit device includes a unit body and a storage box. The storage box is provided with a sensor that detects leakage of the refrigerant and a communicating portion that communicates with the unit body. The storage box is attached to an outer wall portion of the unit body.

10 Claims, 7 Drawing Sheets

(56) References Cited

FOREIGN PATENT DOCUMENTS

| | | | |
|---|---|---|---|
| JP | 2017-015324 | A | 1/2017 |
| JP | 2017-053501 | A | 3/2017 |
| JP | 2017-067392 | A | 4/2017 |

OTHER PUBLICATIONS

Office Action dated May 26, 2020 issued in corresponding JP patent application No. 2019-519799 (and English translation).

* cited by examiner

UNIT DEVICE OF REFRIGERATION CYCLE APPARATUS

CROSS REFERENCE TO RELATED APPLICATION

This application is a U.S. national stage application of PCT/JP2017/018965 filed on May 22, 2017, the contents of which are incorporated herein by reference.

TECHNICAL FIELD

The present invention relates to a unit device of a refrigeration cycle apparatus. The unit device forms part of a refrigerant circuit using flammable or slightly flammable refrigerant, and includes a sensor that detects leakage of the refrigerant.

BACKGROUND ART

In recent years, there has been a trend toward usage of alternatives to chlorofluorocarbons as refrigerants for refrigeration cycle apparatuses in countermeasures against environmental problems, such as global warming and ozone depletion. Examples of these alternatives include R32. Such a refrigerant used in the countermeasures against environmental problems is flammable or slightly flammable. If this refrigerant leaks out of a unit device, the refrigerant may ignite, causing a fire.

A unit device of an existing refrigeration cycle apparatus includes a sensor that detects leakage of refrigerant, and the sensor is provided in close to a drain pan. When the sensor detects leakage of the refrigerant in the unit device, an operation of the refrigeration cycle apparatus is stopped to avoid a fire (see, for example, Patent Literature 1).

CITATION LIST

Patent Literature

Patent Literature 1: Japanese Unexamined Patent Application Publication No. 2002-98346

SUMMARY OF INVENTION

Technical Problem

As described in Patent Literature 1, in general, a sensor that detects refrigerant is attached to the inside of a unit device of a refrigeration cycle apparatus. Therefore, when such a unit device of a refrigeration cycle apparatus is newly developed, it is designed on the premise that space for a sensor that detects refrigerant is provided in the unit device.

Furthermore, in a unit device of an existing refrigeration cycle apparatus using nonflammable chlorofluorocarbon as refrigerant, in the case where the refrigerant is replaced by a refrigerant corresponding to an alternative to chlorofluorocarbon, it is necessary to attach a sensor that detects a flammable or slightly flammable refrigerant to the unit device. However, the unit device of the existing refrigeration cycle apparatus has no space for provision of the refrigerant sensor and thus needs to be greatly modified.

The flammable or slightly flammable refrigerant has a specific gravity greater than air. The refrigerant sensor, therefore, needs to be provided below a refrigerant pipe from which the refrigerant may leak. However, droplets of water of, for example, condensation which is produced during an operation of the refrigeration cycle apparatus, may adhere to the sensor, thus causing occurrence of a failure in the sensor.

The present invention has been made to solve the above problems, and aims to provide a unit device of a refrigeration cycle apparatus in which space for provision of a sensor that detects refrigerant does not need to be provided in a unit body of the unit device and in which the sensor is connected to the unit body without modifying the design of the unit body for provision of the sensor.

Solution to Problem

A unit device of a refrigeration cycle apparatus, according to an embodiment of the present invention, is a unit device that forms part of a refrigerant circuit using flammable or slightly flammable refrigerant, and that includes a unit body and a storage box. The storage box provided with a sensor that detects leakage of the refrigerant and a communicating portion that communicates with the unit body. The storage box is attached to an outer wall portion of the unit body.

Advantageous Effects of Invention

In the unit device of the refrigeration cycle apparatus, according to the embodiment of the present invention, the storage box is attached to the outer wall portion of the unit body. Therefore, it is not necessary to provide in the unit body, space for provision of the sensor, and it is possible to attach the sensor to the unit body without modifying the design of the unit body for attachment of the sensor.

DESCRIPTION OF EMBODIMENTS

Figure 1:
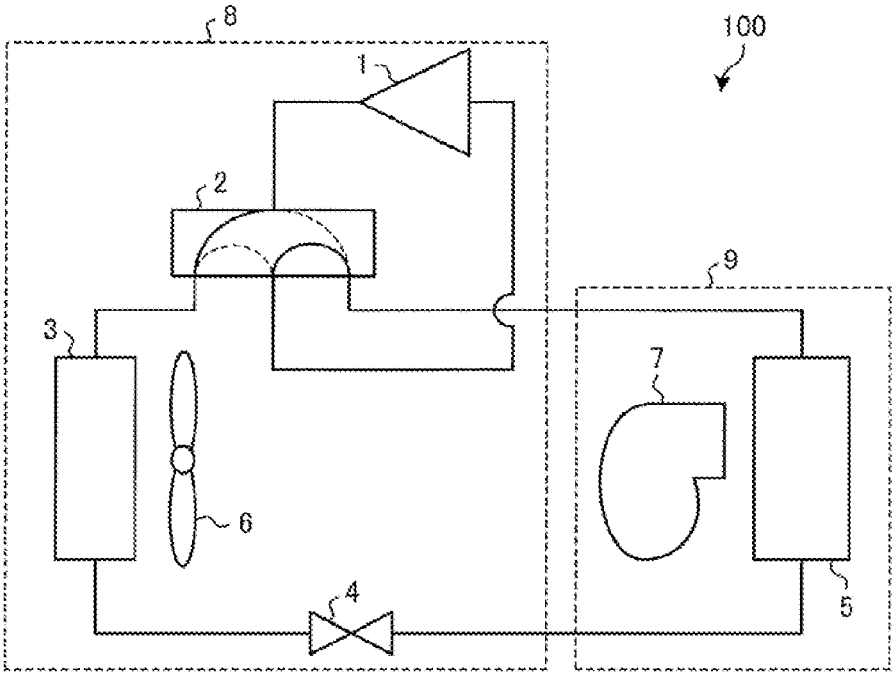
FIG. 1 is a schematic diagram illustrating a configuration example of an air-conditioning apparatus according to Embodiment 1 of the present invention.

The embodiments of the present invention will be described below with reference to the drawings. It should be noted that in each of the figures in the drawings, components which are the same as or equivalent to those in a previous figure are denoted by the same reference signs. Furthermore, the forms of the components referred to in the entire text of the specification are described by way of example, and are not limited to those described in the entire text.

Embodiment 1

Configuration of Air-Conditioning Apparatus 100

FIG. 1 is a schematic diagram of a configuration of an air-conditioning apparatus 100 according to Embodiment 1 of the present invention. As illustrated in FIG. 1, in the air-conditioning apparatus 100, an outdoor unit 8 and an indoor unit 9 are connected by pipes.

The pipes connecting the outdoor unit 8 and the indoor unit 9 are filled with refrigerant for heat transfer and reception. The refrigerant is circulated between the outdoor unit 8 and the indoor unit 9 to perform cooling or heating on space in which the indoor unit 9 is installed. As the refrigerant, for example, a flammable or slightly flammable refrigerant that is an alternative to chlorofluorocarbon, such as R32, is used.

The outdoor unit 8 includes a compressor 1, an outdoor heat exchanger 3, an expansion valve 4, a four-way valve 2, and an outdoor fan 6. The indoor unit 9 includes an indoor heat exchanger 5 and a sirocco fan 7 that operates as an indoor fan.

Configuration of Indoor Unit 9 of Air-Conditioning Apparatus 100

Figure 2:
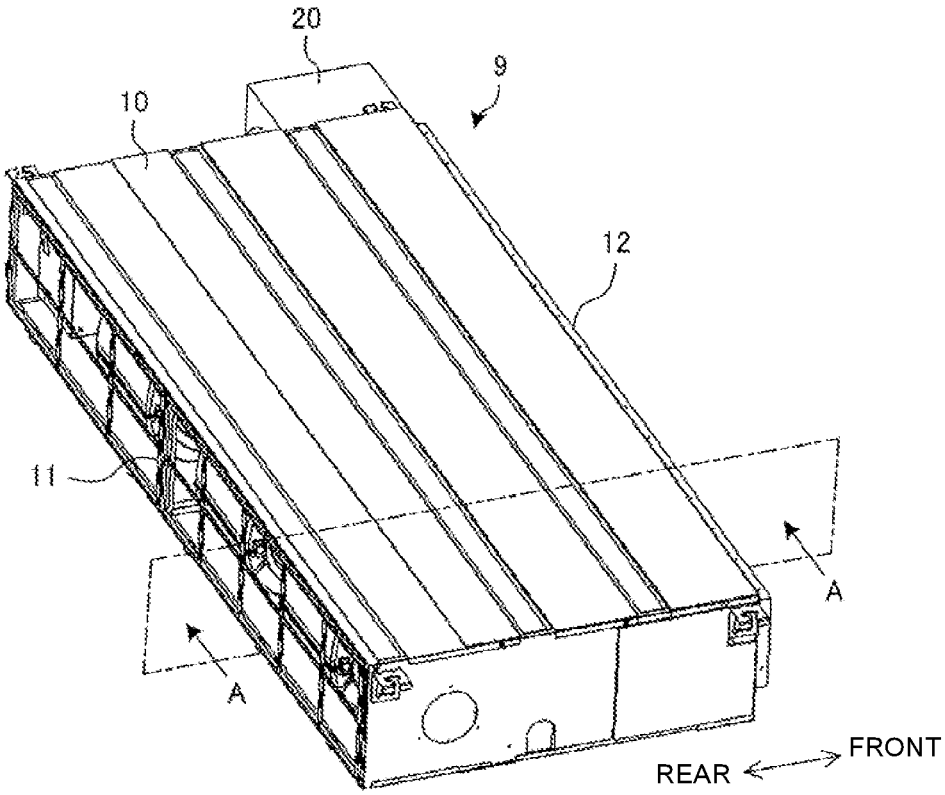
FIG. 2 is a perspective view of an indoor unit of the air-conditioning apparatus according to Embodiment 1 of the present invention.

FIG. 2 is a perspective view of the indoor unit 9 of the air-conditioning apparatus 100 according to Embodiment 1 of the present invention. As illustrated in FIG. 2, the indoor unit 9 of the air-conditioning apparatus 100 is a ceiling mounted indoor unit mounted on the ceiling of a room. The indoor unit 9 of the air-conditioning apparatus 100 includes a unit body 10 and a storage box 20.

As illustrated in FIG. 2, the unit body 10 is a rectangular cuboid. In the unit body 10, an air inlet 11 is formed in an entire rear side surface of the unit body 10, and an air outlet 12 is formed in a front surface of the unit body 10 such that the air outlet 12 is slightly smaller than the entire front surface.

As illustrated in FIG. 2, the storage box 20 is attached to an outer wall of the unit body 10, which is located on a side thereof which corresponds to an upper side of FIG. 2.

Configuration of Unit Body 10

Figure 3:
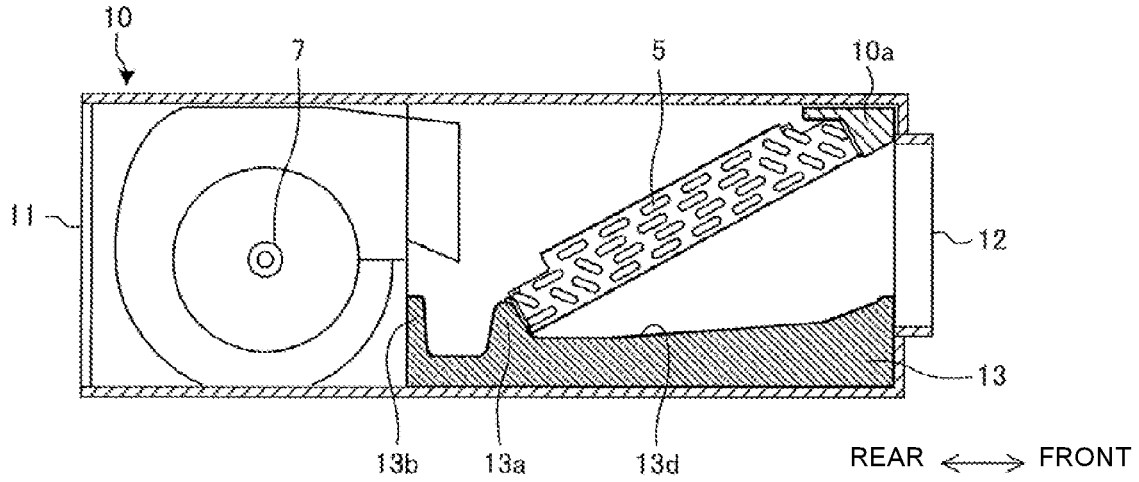
FIG. 3 is a vertical cross-sectional view of the indoor unit of the air-conditioning apparatus according to Embodiment 1 of the present invention, which is taken along line A-A in FIG. 2.
Figure 4:
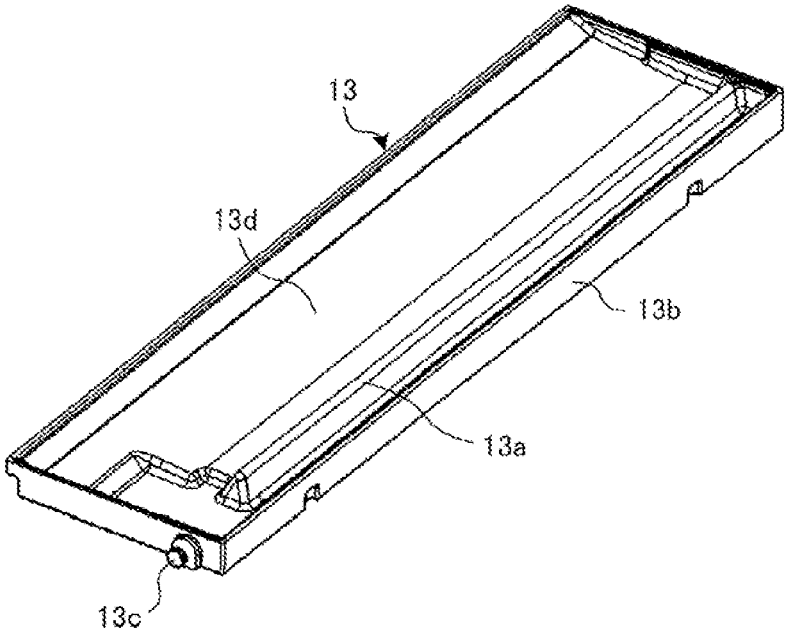
FIG. 4 is a perspective view of a drain pan in Embodiment 1 of the present invention.

FIG. 3 is a vertical cross-sectional view of the indoor unit 9 of the air-conditioning apparatus 100 according to Embodiment 1 of the present invention, which is taken along line A-A in FIG. 2. FIG. 4 is a perspective view of a drain pan 13 in Embodiment 1 of the present invention.

Figure 7:
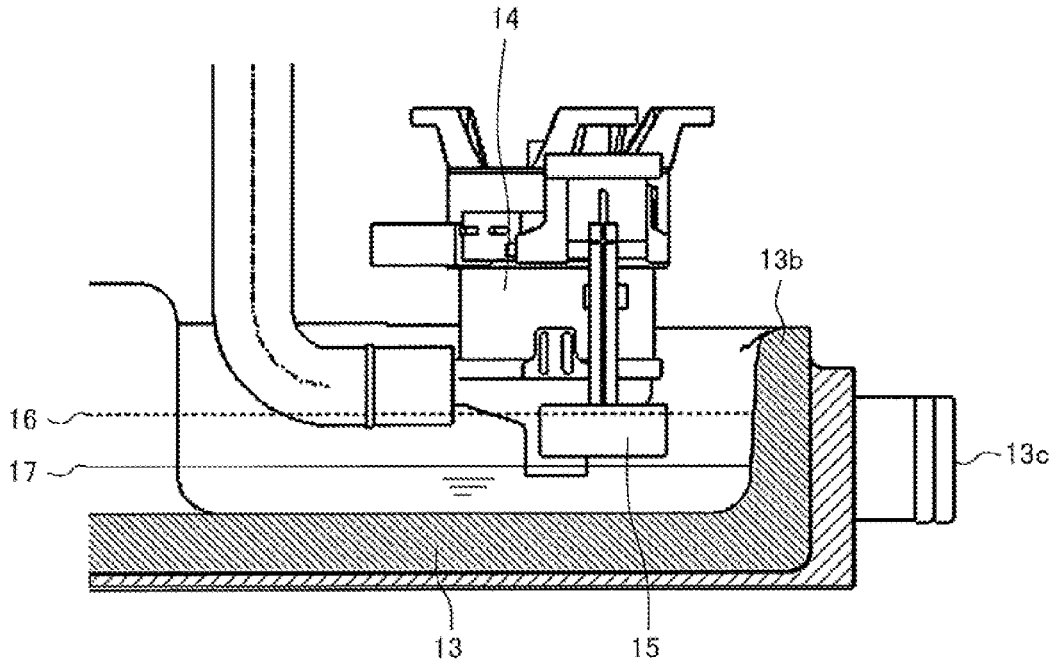
FIG. 7 is a perspective view illustrating the drain pan, a drain pump, and a float switch in Embodiment 1 of the present invention and indicates a positional relationship in level between the drain pan, the drain pump, and the float switch.

As illustrated in FIG. 3, the unit body 10 includes the indoor heat exchanger 5, the sirocco fan 7, and the drain pan 13. As illustrated in FIG. 7, which will be described later, the unit body 10 further includes a drain pump 14 and a float switch 15.

As illustrated in FIG. 3, the indoor heat exchanger 5 is formed in the shape of a thin plate. The indoor heat exchanger 5 is held by a support portion 10*a* and a raised portion 13*a* of the drain pan 13. The support portion 10*a* is located at an inner upper portion of the unit body 10 and close to the air outlet 12, and the raised portion 13*a* is located at an inner lower portion of the unit body 10. Thus, the indoor heat exchanger 5 is inclined in the unit body 10 such that a front portion of the indoor heat exchanger 5 is located at a high level and a rear portion of the indoor heat exchanger 5 is located at a low level, that is, flat surfaces of the indoor heat exchanger 5 are inclined, as illustrated in the vertical cross-sectional view. The indoor heat exchanger 5 is connected to a refrigerant pipe (not illustrated). The indoor heat exchanger 5 transfers heat between refrigerant that flows in the refrigerant pipe and air that flows in the unit body 10. The refrigerant pipe allows the refrigerant to flow from the outdoor unit 8 to the indoor heat exchanger 5.

As illustrated in FIG. 3, the sirocco fan 7 is located closer to the rear side of the unit body 10 than the indoor heat exchanger 5 in the unit body 10 and in parallel with the indoor heat exchanger 5 in a horizontal direction. The sirocco fan 7 sends air taken from indoor space through the air inlet 11 to the indoor heat exchanger 5. The air sent to the indoor heat exchanger 5 exchanges heat with the refrigerant that flows in the refrigerant pipe and then in the indoor heat exchanger 5. Conditioned air subjected to heat exchange in the indoor heat exchanger 5 is blown out of the indoor heat exchanger 5 through the air outlet 12 located in front of the indoor heat exchanger 5.

As illustrated in FIG. 3, the drain pan 13 is located at the lowest position in the unit body 10. Also, the drain pan 13 is provided to extend over an area that is located below the indoor heat exchanger 5 and the refrigerant pipe (not illustrated) and corresponds to the total area of the indoor heat exchanger 5 and the refrigerant pipe. The drain pan 13 receives water of condensation which is produced by condensation that occurs when the air is rapidly cooled by the refrigerant that passes through the indoor heat exchanger 5 or the refrigerant pipe.

As illustrated in FIG. 4, the drain pan 13 includes wall portions 13*b* at four sides of the drain pan 13. The drain pan 13 includes a natural outlet 13*c* through which drain water flows out of the drain pan 13 to the outside thereof. To be more specific, water of condensation is received in the drain pan 13 and collected as drain water in the drain pan 13, and the drain water flows out of the drain pan 13 through the natural outlet 13*c*. Although the natural outlet 13*c* is located on a lower side of FIG. 4, it is located close to the storage box 20 on the upper side of FIG. 2. Water of condensation that is produced at the indoor heat exchanger 5 or the refrigerant pipe drops onto a reception surface 13*d* of the drain pan 13 and is collected as drain water. The reception surface 13*d* of the drain pan 13 is inclined such that the natural outlet 13*c* is located at the lowest position. Because of this configuration, even if dropping at any position on the drain pan 13, water of condensation finally reaches as drain water the natural outlet 13*c*, and naturally flows out of the drain pan 13 through the natural outlet 13*c*.

Figure 5:
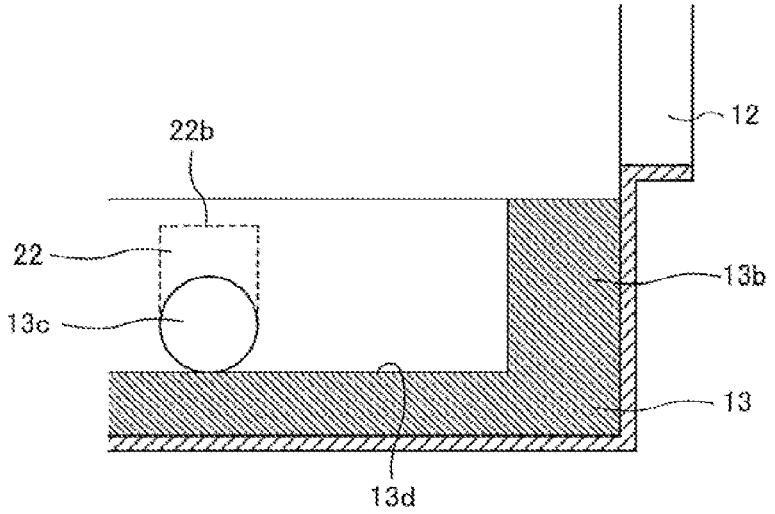
FIG. 5 is an enlarged vertical sectional view of part of the indoor unit of the air-conditioning apparatus according to Embodiment 1 of the present invention, which includes a natural discharge outlet.

FIG. 5 is an enlarged vertical sectional view of part of the indoor unit 9 that includes the natural outlet 13*c* in the air-conditioning apparatus 100 according to Embodiment 1 of the present invention. As illustrated in FIG. 5, a lowermost portion of the natural outlet 13*c* is located at the reception surface 13*d* of the drain pan 13. In FIG. 5, a dashed line indicates an L-shaped socket 22 which will be described later and is provided to communicate with the natural outlet 13*c*.

Configuration of Storage Box 20

Figure 6:
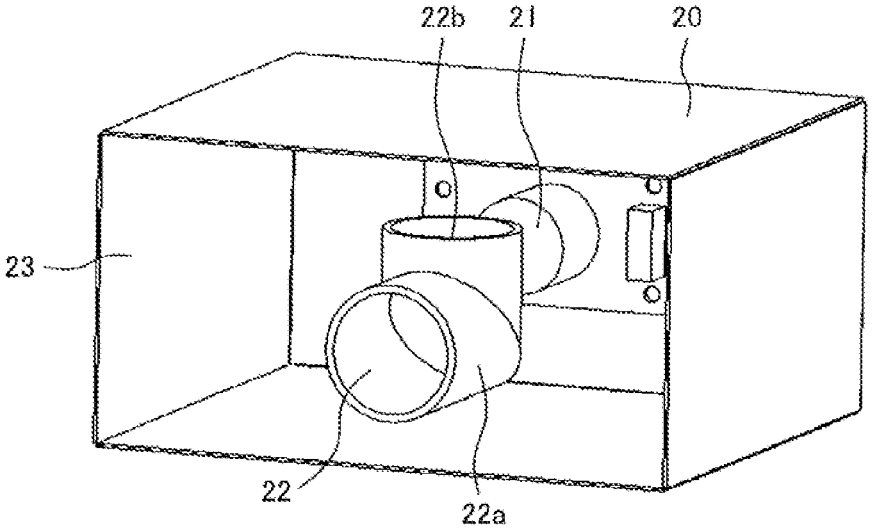
FIG. 6 is a perspective view of a storage box in Embodiment 1 of the present invention and illustrates an internal configuration of the storage box.

FIG. 6 is a perspective view of the storage box 20 in Embodiment 1 of the present invention and illustrates an internal configuration of the storage box 20. As illustrated in FIG. 6, the storage box 20 includes a sensor 21 and the L-shaped socket 22.

As illustrated in FIG. 6, the storage box 20 has an opening portion 23 that serves as a communication portion having no wall and is formed in part of the storage box 20 that is attached to an outer wall portion of the unit body 10. A surrounding portion of the opening portion 23 of the storage box 20 is in tightly fixed to the outer wall portion of the unit body 10. The storage box 20 stores refrigerant leaking from the unit body 10. Thereby, the refrigerant stored in the storage box 20 is prevented from flowing out of the storage box 20 to the outside. Furthermore, the sensor 21 detects the refrigerant with a higher accuracy.

The sensor 21 detects refrigerant leaking from the unit body 10. The sensor 21 is attached to an inner wall portion of the storage body 20 that is located at an innermost part of the storage box 20 and faces the opening portion 23 of the storage box 20. The opening portion 23 communicates with the unit body 10. Thus, the refrigerant leaking from the unit body 10 flows toward the sensor 21 through the opening portion 23.

The L-shaped socket 22 is a tubular element and allows the inside of the unit body 10 and the inside of the storage box 20 to communicate with each other via the opening portion 23. The L-shaped socket 22 includes a horizontal tube portion 22*a* and a vertical tube portion 22*b*. The horizontal tube portion 22*a* extends from the natural outlet 13*c* to the unit body 10 and opens to the unit body 10. The vertical tube portion 22*b* extends upwards from an end of the horizontal tube portion 22*a* that is located in the storage box 20, and has an opening at its upper end, that is, the L-shaped socket 22 is bent upwards at the end of the horizontal tube portion 22*a*.

Positional Relationship in Level Between Drain Pan 13, Drain Pump 14, and Float Switch 15

FIG. 7 is a perspective view illustrating the drain pan 13, the drain pump 14, and the float switch 15 in Embodiment 1 of the present invention, and illustrates a positional relationship in level between the drain pan 13, the drain pump 14, and the float switch 15. As illustrated in FIG. 7, the unit body 10 includes the drain pump 14 and the float switch 15.

As illustrated in FIG. 7, the drain pump 14 is located above the drain pan 13. The drain pump 14 sucks drain water collected in the drain pan 13 during an operation of the air-conditioning apparatus 100 and discharges the drain water to the outside of the unit body 10.

As illustrated in FIG. 7, the float switch 15 is a component of the drain pump 14. The float switch 15 detects that a water level of the drain water collected in the drain pan 13 reaches a detection water level 16 which is a constant value. When the float switch 15 detects that the drain water reaches the detection water level 16, the operation of the air-conditioning apparatus 100 is stopped.

As illustrated in FIG. 7, while the air-conditioning apparatus 100 is in operation, the drain water collects up to an operation water level 17, at which the drain pump 14 can suck the drain water, at the drain pan 13. The float switch 15 prevents the drain water from overflowing from the drain pan 13 because of an increase in the water level of the drain water, which would be caused by, for example, a failure of the drain pump 14 during the operation of the air-conditioning apparatus 100. It should be noted that in Embodiment 1, the drain pump 14 is provided, and the drain pan 13 includes the natural outlet 13*c*, which is an already available drain outlet. Since the drain pan 13 having such a natural outlet 13*c* is used, it can be manufactured as a general component, regardless of the drain pump 14 is provided or not. It is therefore possible to reduce the manufacturing cost.

Details of L-Shaped Socket 22

Figure 8:
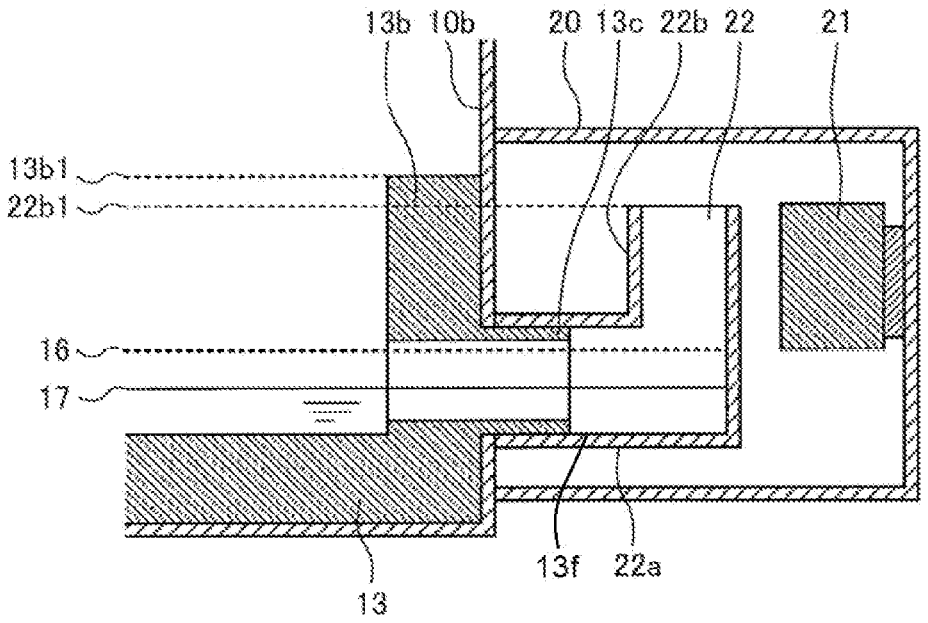
FIG. 8 is a vertical sectional view illustrating the storage box and part of a unit body that adjoins the storage box in Embodiment 1 of the present invention.

FIG. 8 is a vertical sectional view illustrating the storage box 20 and part of the unit body 10 that adjoins the storage box 20 in Embodiment 1 of the present invention. As illustrated in FIG. 8, the storage box 20 is attached to an outer wall portion 10*b* of a side of the unit body 10, in order that refrigerant leaking from the unit body 10 be collected. An opening portion of the horizontal tube portion 22*a* of the L-shaped socket 22 is connected with the natural outlet 13*c* of the drain pan 13. Thereby, the L-shaped socket 22 serves as a passage to introduce the refrigerant leaking from the unit body 10 into the storage box 20. In other words, the natural outlet 13*c* communicates with the storage box 20 via the opening portion 23. In the storage box 20, the sensor 21 is provided to detect refrigerant flowing in the L-shaped socket 22.

The refrigerant has a greater specific gravity than air. Therefore, the refrigerant leaking from, for example, the refrigerant pipe, falls and collects in the drain pan 13 located in the lower portion of the unit body 10. In Embodiment 1, the L shaped socket 22, which is tubular, is attached to the natural outlet 13*c* of the drain pan 13, thereby forming a refrigerant passage 13*f*. Thereby, the refrigerant leaking in the unit body 10 flows through the L-shaped socket 22 and collects in the storage box 20. The sensor 21 detects the refrigerant in the storage box 20. As a result, it can be detected that the refrigerant leaks from, for example, the refrigerant pipe.

The shape of the L-shaped socket 22 is determined based on the relationship between the amount of water of condensation that is produced at the indoor heat exchanger 5 or the refrigerant pipe, the shape of the drain pan 13, and the detection water level 16 for the float switch 15. It should be noted that if the L-shaped socket 22 were not provided, the drain water would flow through the natural outlet 13*c* into the storage box 20 attached to the outer wall portion of the unit body 10, and collect in the storage box 20, and then adheres to the sensor 21. In contrast, in Embodiment 1, the L-shaped socket 22 is provided, and the vertical tube portion 22*b* of the L-shaped socket 22 serves as a wall that prevents leakage of the drain water at the operation water level 17. Thereby, the drain water that collects in the drain pan 13 during the operation of the air-conditioning apparatus 100 does not flow out of the indoor unit 9 at the operation water level 17. Furthermore, the drain water collecting in the drain pan 13 does not directly flow into the storage box 20 through the natural outlet 13*c*. Thus, the drain water does not reach the sensor 21.

As illustrated in FIG. 8, the upper end of the vertical tube portion 22*b* of the L-shaped socket 22 is located at a level 22*b*1, which is set higher than the operation water level 17 at which the drain pump 14 can suck the drain water, and preferably, should be set higher than the detection water level 16 for the float switch 15, and is also set lower than a height 13*b*1 of a wall portion 13*b* of the drain pan 13. When the drain water collects such that the level of the drain water is higher than or equal to the detection water level 16 for the float switch 15 in the drain pan 13, the operation of the air-conditioning apparatus 100 is stopped. Since the level 22*b*1 of the upper end of the vertical tube portion 22*b* of the L-shaped socket 22 is higher than the detection water level 16 for the float switch 15, the drain water that collects in the drain pan 13 does not flow over the upper end of the vertical tube portion 22*b* of the L-shaped socket 22 into the storage box 20, and thus does not reach the sensor 21.

As illustrated in FIG. 8, the level 22*b*1 of the upper end of the vertical tube portion 22*b* of the L-shaped socket 22 is set lower than the height 13*b*1 of the wall portion 13*b* of the drain pan 13. Therefore, the refrigerant that leaks from, for example, the refrigerant pipe, and collects in the drain pan 13 flows into the storage box 20 through the L-shaped socket 22, that is, it does not flow over the drain pan 13, and collects in the storage box 20. Thus, leakage refrigerant can be detected by the sensor 21.

Advantages of Embodiment 1

In Embodiment 1, the indoor unit 9 is a unit device of the refrigeration cycle apparatus, and forms part of the refrigerant circuit that uses the flammable or slightly flammable refrigerant. The indoor unit 9 includes the unit body 10 and the storage box 20. In the storage box 20, the sensor 21 is provided to detect leakage of the refrigerant. The storage box 20 has the opening portion 23 that serves as a communicating portion communicating with the unit body 10. The storage box 20 is attached to the outer wall portion 10*b* of the unit body 10.

In the above configuration, the sensor 21 that detects leakage of the refrigerant is provided in the storage box 20 attached to the outer wall portion 10*b* of the unit body 10. Therefore, the unit body 10 does not need space for provision of the sensor 21 that detects refrigerant in the unit body 10, and the sensor 21 can be provided without modifying the design of the unit body 10 for provision of the sensor 21. In addition, the sensor 21 is provided in the storage box 20, and droplets of water, for example, water of condensation that is produced in the unit body 10 do not adhere to the sensor 21. It is therefore possible to prevent occurrence of a failure in the sensor 21, which would be caused by water droplets. In addition, the sensor 21 is provided in the storage box 20 and is located outside the unit body 10. The maintenance of the sensor 21 is therefore easily carried out. For example, in the case where a technician replaces the sensor 21 by a new one, he or she has only to detach the storage box 20. That is, he or she can achieve the replacement of the sensor 21 at a high efficiency. Furthermore, the storage box 20 may have a communication portion other than the opening portion 23. For example, the storage box may have a hole, as a communication portion, in a side wall portion of the storage box.

In Embodiment 1, the unit body 10 of the indoor unit 9 includes the drain pan 13 that receives water of condensation. The drain pan 13 has the natural outlet 13*c* for drain water. The natural outlet 13*c* communicates with the storage box 20 via the opening portion 23.

In such a configuration, the natural outlet 13*c* which is an already available drain outlet and provided in the drain pan 13 is used as an inlet through which leakage refrigerant flows into the storage box 20. Therefore, the unit body 10 having the natural outlet 13*c* is more effectively used without modifying the design of the unit body 10.

In Embodiment 1, the indoor unit 9 includes the L-shaped socket 22 as a socket that communicates with the unit body 10 and the storage box 20 via the opening portion 23.

In the above configuration, the L-shaped socket 22 communicates with the unit body 10 and the storage box 20. Thus, the L-shaped socket 22 allows the refrigerant leaking from the unit body 10 to flow toward the sensor 21.

In Embodiment 1, the L-shaped socket 22 includes the horizontal tube portion 22*a* that is connected with the natural outlet 13*c* and opens to the unit body 10, and the vertical tube portion 22*b* that extends upwards from the end of the horizontal tube portion 22*a*, which is located in the storage box 20, and that has an opening at its upper end. An upper end portion of the vertical tube portion 22*b* is located at the level 22*b*1, which is higher than the operation water level 17 at which the drain pump 14 can suck the drain water and is lower than an upper end portion of the wall portion 13*b* of the drain pan 13.

In the above configuration, the L-shaped socket 22 communicates with the unit body 10 and the storage box 20 via the natural outlet 13*c*. Therefore, the L-shaped socket 22 allows the refrigerant leaking from the unit body 10 to flow toward the sensor 21 such that the refrigerant flows over the drain water collecting in the natural outlet 13*c*. Thus, the sensor 21 can early detect the leakage refrigerant on the drain water received in the drain pan 13. Furthermore, since the upper end portion of the vertical tube portion 22*b* is located at a higher level than the operation water level 17 at which the drain pump 14 can suck the drain water, the drain water that collects in the drain pan 13 in the operation of the air-conditioning apparatus 100 does not overflow from the drain pan 13 at the operation water level 17. Additionally, the refrigerant leaking from, for example, the refrigerant pipe, flows over the drain water that collects in the drain pan 13 at the operation water level 17, flows through the L-shaped socket 22, then flows into the storage box 20, and can thus be detected by the sensor 21. Thus, the refrigerant leaking from, for example, the refrigerant pipe, and collecting in the drain pan 13 can be detected by the sensor 21 before overflowing the drain pan 13. The socket 22 is not limited the L-shaped socket. As the socket 22, any socket can be used as long as it is formed to communicate with the unit body 10 and the storage box 20.

In Embodiment 1, the indoor unit 9 is an indoor unit of the air-conditioning apparatus 100 and includes the indoor heat exchanger 5, the refrigerant pipe that allows the refrigerant to flow in the indoor heat exchanger 5, and the sirocco fan 7 that sends air to the indoor heat exchanger 5, such that the indoor heat exchanger 5, the refrigerant pipe and the sirocco fan 7 are provided in the unit body 10.

In such a configuration, the indoor unit 9 of the air-conditioning apparatus 100 does not need space for provision of the sensor 21 that detects refrigerant in the unit body 10, and the sensor 21 can be attached without modifying the unit body 10.

In Embodiment 1, the indoor unit 9 is a ceiling mounted indoor unit attached to the ceiling of a room.

In the above configuration, the ceiling mounted indoor unit 9 of the air-conditioning apparatus 100 does not need space for provision of the sensor 21 that detects refrigerant in the unit body 10, and the sensor 21 can be attached without modifying the design of the unit body 10. As a result, leakage refrigerant can be detected by the sensor 21 before falling into the room and flying off in the room.

Embodiment 2

Figure 9:
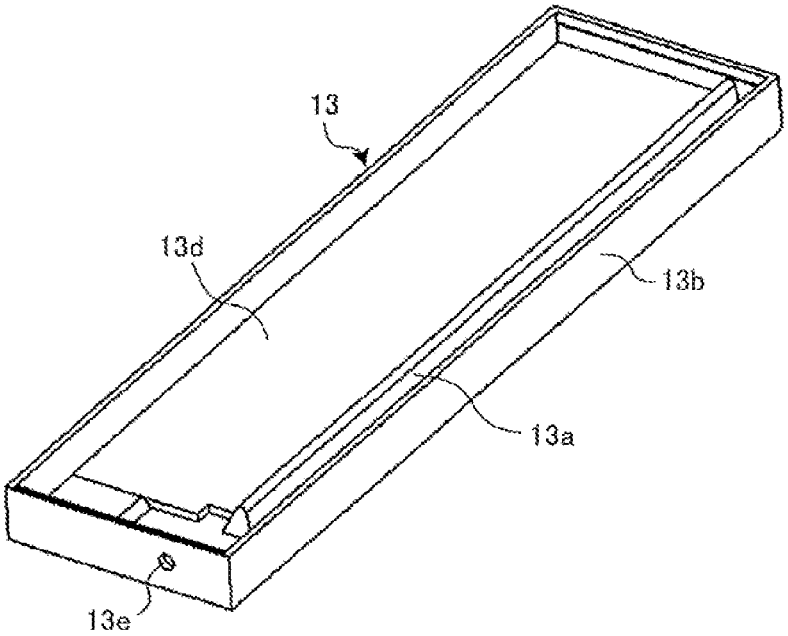
FIG. 9 is a perspective view of the drain pan in Embodiment 2 of the present invention.
Figure 10:
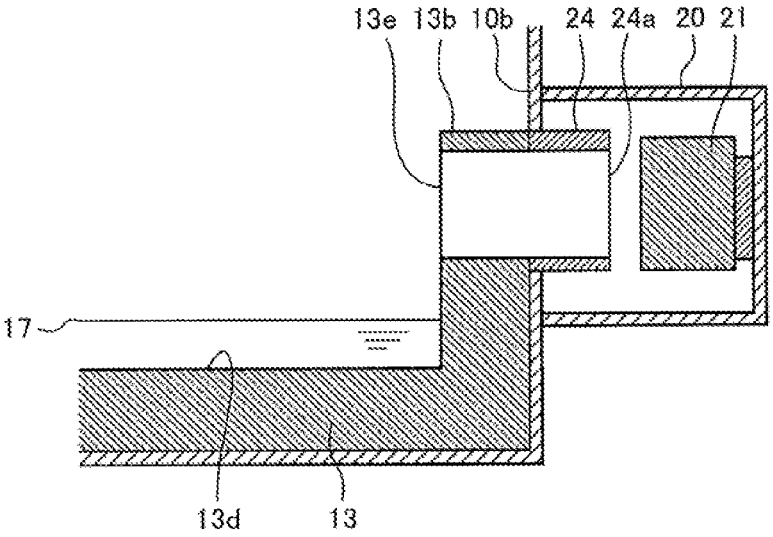
FIG. 10 is a vertical sectional view illustrating the storage box and part of the unit body that adjoins the storage box in Embodiment 2 of the present invention.

FIG. 9 is a perspective view of the drain pan 13 in Embodiment 2 of the present invention. FIG. 10 is a vertical sectional view illustrating the storage box 20 and part of the unit body 10 that adjoins the storage box 20 in Embodiment 2 of the present invention. Regarding Embodiment 2, the same descriptions as made regarding Embodiment 1 will be omitted, and only features of Embodiment 2 which are different from those of Embodiment 1 will be described.

As illustrated in FIG. 9, the drain pan has a ventilation hole 13*e* that differs from a drain outlet. In the case where the drain pan does not have such a natural outlet 13*c* as described with respect to Embodiment 1, or in the where the natural outlet 13*c* is connected with a pipe in an actual place, the ventilation hole 13*e* is provided in the wall portion 13*b* of the drain pan 13 as a ventilation not intended for drainage. Thereby, the refrigerant leaking from, for example, the refrigerant pipe and collecting in the drain pan 13 flows into the storage box 20 through the ventilation hole 13*e*. To be more specific, the ventilation hole 13*e* communicates with the storage box 20 via the opening portion 23, and the sensor 21 can thus detect the refrigerant flowing into the storage box 20 through the ventilation hole 13*e*.

As illustrated in FIG. 10, a tubular socket 24 is attached to the ventilation hole 13*e* formed in the wall portion 13*b* of the drain pan 13. The refrigerant leaking from the refrigerant pipe collects in the drain pan 13, flows through the socket 24, and is then detected by the sensor 21, as in Embodiment 1.

As illustrated in FIG. 10, the ventilation hole 13*e* formed in the wall portion 13*b* of the drain pan 13 is located at a level that is higher level than the operation water level 17 at which the drain pump 14 can suck the drain water, and preferably should be higher than the detection water level 16 of the float switch 15, and is also lower than the upper end portion of the wall portion 13*b* of the drain pan 13.

The tubular socket 24 can be formed to have a simple configuration and a smaller size. In such a manner, since the socket 24 is formed to have a smaller size, the distance between the sensor 21 and an end 24*a* of the socket 24 that is located in the storage box 20 is shortened. Since the distance is shortened, the sensor 21 can earlier detect the refrigerant flowing through the socket 24.

Advantages of Embodiment 2

In Embodiment 2, the unit body 10 of the indoor unit 9 includes the drain pan 13 that receives water of condensation. The drain pan 13 has the ventilation hole 13*e*. The ventilation hole 13*e* communicates with the storage box 20 via the opening portion 23. The ventilation hole 13*e* is located at a level higher than the operation water level 17, at which the drain pump 14 can suck the drain water, and lower than the upper end portion of the wall portion 13*b* of the drain pan 13.

In such a configuration, the ventilation hole 13*e* of the drain pan 13 is used as an inlet through which leakage refrigerant flows into the storage box 20. Therefore, the unit body 10 having the ventilation hole 13*e* can be more effectively used without modifying the design of the unit body 10. In addition, the drain water that collects in the drain pan 13 in the operation of the air-conditioning apparatus 100 does not overflow from the drain pan 13 at the operation water level 17, at which the drain pump 14 can suck the drain water. Furthermore, the refrigerant leaking from, for example, the refrigerant pipe, flows over the drain water that collects in the drain pan 13 at the operation water level 17, flows into the storage box 20 through the ventilation hole 13*e* and the socket 24, and can be detected by the sensor 21. Thus, the refrigerant leaking from, for example, the refrigerant pipe and collecting in the drain pan 13 can be detected by the sensor 21 before overflowing from the drain pan 13.

Embodiment 3

First Configuration Example

Figure 11:
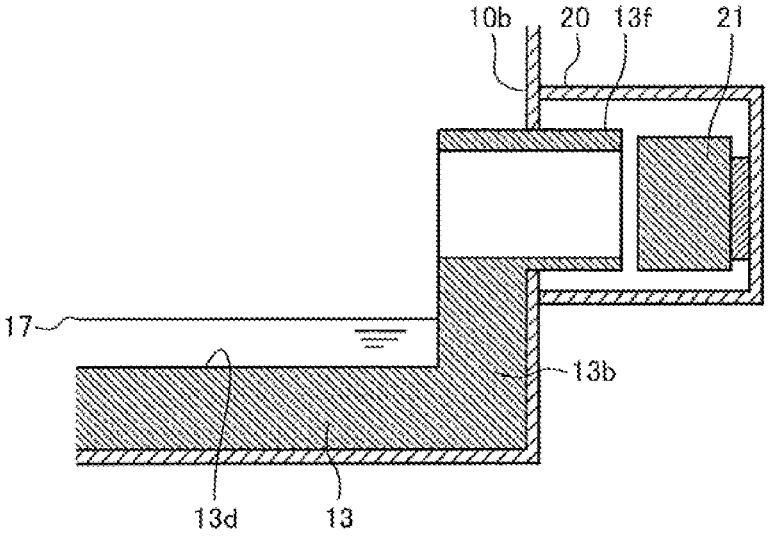
FIG. 11 is a vertical sectional view illustrating the storage box and part of the unit body that adjoins the storage box in a first configuration example of Embodiment 3 of the present invention.

FIG. 11 is a vertical sectional view illustrating the storage box 20 and part of the unit body 10 that adjoins the storage box 20 in a first configuration example of Embodiment 3 of the present invention. Regarding the first configuration example of Embodiment 3, the same descriptions as made regarding the above embodiments will be omitted, and only features of the first configuration example of Embodiment 3 which are different from those of the above embodiments will be described.

As illustrated in FIG. 11, the drain pan 13 has a flow passage 13*f* that extends to the storage box 20 and serves as a communication portion communicating with the storage box 20 and the unit body 10 via the opening portion 23. The flow passage 13*f* is a tubular portion and formed integrally with the drain pan 13.

As illustrated in FIG. 11, the flow passage 13*f* that is formed to project from the wall portion 13*b* of the drain pan 13 is located at a level that is higher than the operation water level 17 at which the drain pump 14 can suck the drain water, and preferably should be higher than the detection water level 16 of the float switch 15, and is also lower than the upper end portion of the wall portion 13*b* of the drain pan 13.

The flow passage 13*f* is provided to cause the refrigerant on the drain water in the drain pan 13 to flow directly to the sensor 21. Thereby, the distance between the sensor 21 and an outlet portion of the flow passage 13*f* is shortened, and leakage of the refrigerant can thus be rapidly detected. Furthermore, the flow passage 13*f* is provided far away from an electrical component box (not illustrated) provided in the unit body 10. Thereby, the refrigerant flowing through the flow passage 13*f* is located far away from the electrical component box, thus preventing ignition of the flammable or slightly flammable refrigerant.

Second Configuration Example

Figure 12:
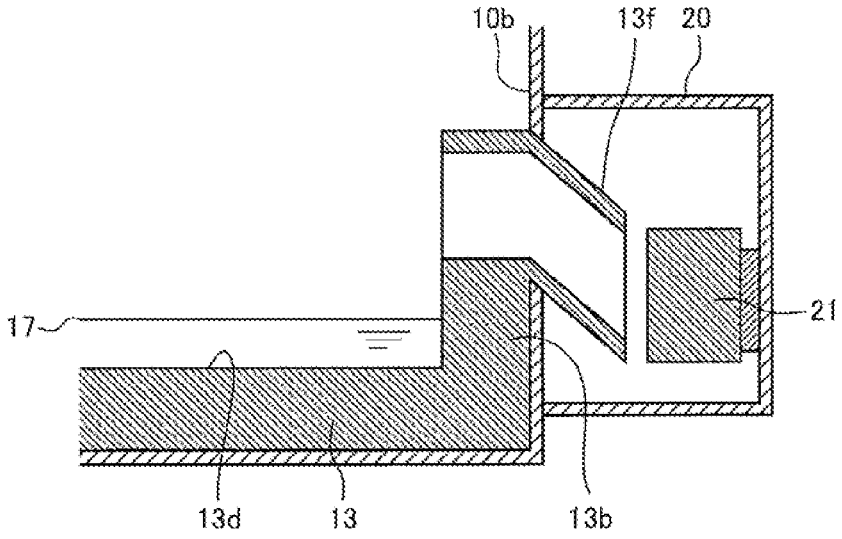
FIG. 12 is a vertical sectional view illustrating the storage box and part of the unit body that adjoins the storage box in a second configuration example of Embodiment 3 of the present invention.

FIG. 12 is a vertical sectional view illustrating the storage box 20 and part of the unit body 10 that adjoins the storage box 20 in a second configuration example of Embodiment 3 of the present invention. With respect to the second configuration example of Embodiment 3, descriptions concerning components which are the same as those of the above Embodiments will be omitted, and only a feature of the second configuration which are not included in the Embodiments will be described.

The feature of the flow passage 13*f* which allows the refrigerant to flow therethrough varies in accordance with the shape of the flow passage 13*f*. For example, as illustrated in FIG. 12, the outlet portion of the flow passage 13*f*, which is located in the storage box 20, is inclined downwards. In such a case, the refrigerant is heavier than air, and thus flows downwards to the right side of FIG. 12 along the inclined part of the flow passage 13*f* and then reaches the sensor 21. Thereby, the refrigerant reaches the sensor 21 for a shorter time period. The refrigerant can thus be earlier detected by the sensor 21.

Third Configuration Example

Figure 13:
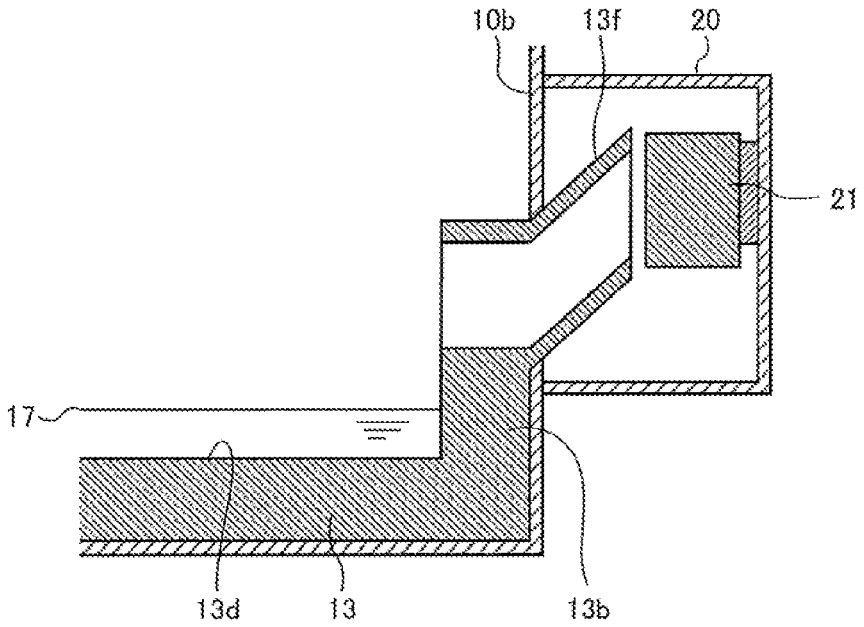
FIG. 13 is a vertical sectional view illustrating the storage box and part of the unit body that adjoins the storage box in a third configuration example of Embodiment 3 of the present invention.

FIG. 13 is a vertical sectional view illustrating the storage box 20 and part of the unit body 10 that adjoins the storage box 20 in a third configuration example of Embodiment 3 of the present invention. Regarding the third configuration example of Embodiment 3, the same descriptions as made regarding the above embodiments will be omitted, and only a feature of the third configuration example of Embodiment 3 which are different from those of the embodiments will be described.

As illustrated in FIG. 13, the outlet portion of the flow passage 13*f* that is located in the storage box 20 is inclined upwards. In such a case, water of condensation that is produced during the operation of the air-conditioning apparatus 100 does not flow from the drain pan 13 into the storage box 20 through the flow passage 13*f*.

In the operation of the air-conditioning apparatus 100, the sirocco fan 7 causes the drain water that collects in the drain pan 13 to spatter. However, the spattering drain water does not enter the storage box 20 because of provision of the flow passage 13*f* that is inclined upwards toward the right side of FIG. 13.

Advantages of Embodiment 3

In Embodiment 3, the drain pan 13 has the flow passage 13*f* that extends to the storage box 20 and communicates with the unit body 10 and the storage box 20 via the opening portion 23 that serves as communicating portion.

In the above configuration, the flow passage 13*f* extending from the drain pan 13 to the storage box 20 communicates with the unit body 10 and the storage box 20. Thus, the flow passage 13*f* allows the refrigerant leaking from the unit body 10 to flow to the sensor 21.

Embodiment 4

Figure 14:
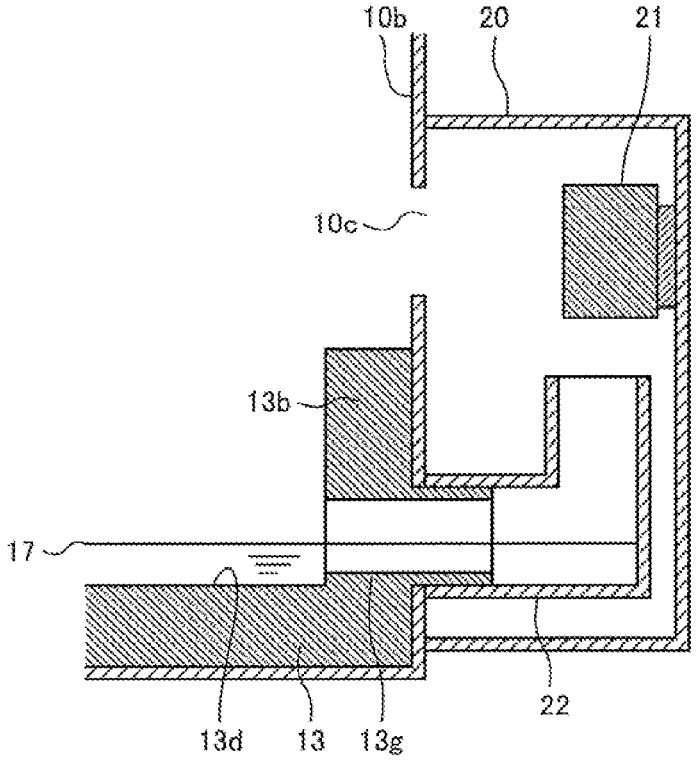
FIG. 14 is a vertical sectional view illustrating the storage box and part of the unit body that adjoins the storage box in Embodiment 4 of the present invention.

FIG. 14 is a vertical sectional view illustrating the storage box 20 and part of the unit body 10 that adjoins the storage box 20 in Embodiment 4 of the present invention. Regarding Embodiment 4, the same descriptions as made above regarding the above embodiments will be omitted, and only features of Embodiment 4 that are different from those of the embodiments will be described.

As illustrated in FIG. 14, a hole is formed as a vent 10C in the outer wall portion 10*b* of the unit body 10, to which the storage box 20 is attached. The vent 10*c* communicates with an inner space of the unit body 10 and an inner space of the storage box 20. The vent 10*c* communicates with the storage box 20 via the opening portion 23. The vent 10*c* of the outer wall portion 10*b* is located at a level higher than the drain pan 13. The sensor 21 is provided on an imaginary line extending inwardly from the vent 10*c* to an inner part of the storage box 20. Thereby, when the refrigerant leaking from, for example, the refrigerant pipe, flows from the unit body 10 into the vent 10*c*, the refrigerant can be detected. When the refrigerant is moved to the innermost part of the storage box 20 through the vent 10*c*, air sent from the sirocco fan 7 in the indoor unit 9 can be used. Thus, leakage of the refrigerant can be detected earlier.

As illustrated in FIG. 14, a ventilation hole 13*g* is formed in the drain pan 13. The ventilation hole 13*g* may be any of the natural outlet 13*c*, the L-shaped socket 22, the ventilation hole 13*e* provided in the wall portion 13*b* of the drain pan 13, and the flow passage 13*f* formed integral with the drain pan 13 and allowing the refrigerant to flow, which are all described with respect to the above embodiments.

Advantages of Embodiment 4

In Embodiment 4, the indoor unit 9 has the vent 10*c* communicating with the inner space of the unit body 10 and the inner space of the storage box 20. The vent 10*c* communicates with the storage box 20 via the opening portion 23.

In such a manner, since the vent 10*c* communicates with the inner space of the unit body 10 and the inner space of the storage box 20, the vent 10*c* allows the refrigerant leaking from the unit body 10 to flow toward the sensor 21 provided in the storage box 20.

The above embodiments are described above by referring to by way of example the case where the storage box is attached to the wall portion of the unit body, which forms a side of the unit body. However, this is not limitative. The storage box may be attached to a lower surface of the unit body. For example, the storage box may be attached to the lower surface of the unit body such that the refrigerant that overflows from the drain pan can be detected.

The above embodiments of the present invention are described above by referring to by way of example the case where each of the embodiments is applied to an indoor unit of an air-conditioning apparatus. However, this is not limitative. For example, each embodiment may be applied to an outdoor unit of an air-conditioning apparatus. Furthermore, each embodiment may be applied to refrigeration cycle apparatuses other than an air-conditioning apparatus, for example, a refrigeration apparatus and a water heater.

REFERENCE SIGNS LIST

1 compressor 2 four-way valve 3 outdoor heat exchanger 4 expansion valve 5 indoor heat exchanger 6 outdoor fan 7 sirocco fan 8 outdoor unit 9 indoor unit 10 unit body 10*a* support portion 10*b* outer wall portion 10*c* vent 11 air inlet 12 air outlet 13 drain pan 13*a* raised portion 13*b* wall portion 13*b*1 height 13*c* natural outlet 13*d* reception surface 13*e* ventilation hole 13*f* passage 13*g* ventilation hole 14 drain pump 15 float switch 16 detection water level 17 operation water level 20 storage box 21 sensor 22 L-shaped socket 22*a* horizontal tube portion 22*b* vertical tube portion 22*b*1 level 23 opening portion 24 socket 24*a* end 100 air-conditioning apparatus

The invention claimed is:

1. A unit device of a refrigeration cycle apparatus, the unit device forming part of a refrigerant circuit using flammable or slightly flammable refrigerant, and comprising:

a unit body; and a storage box that stores refrigerant leaking from the unit body, the storage box being provided with a sensor configured to detect leakage of the refrigerant and a communicating portion configured to communicate with the unit body, the storage box being attached to an outer wall portion of the unit body, wherein the sensor is attached to an inner wall portion of the storage box, wherein in the unit body, a drain pan is provided, the drain pan being configured to receive water of condensation, wherein the drain pan has a natural discharge outlet for drain water, and wherein the natural discharge outlet communicates with the storage box via the communicating portion.

2. The unit device of claim 1 further comprising:

a socket configured to communicate with the unit body and the storage box via the communicating portion.

3. The unit device of claim 2, wherein the socket is an L-shaped socket including a horizontal tube portion that is connected with the natural discharge outlet and opens to the unit body and a vertical tube portion that extends upwards from an end of the horizontal tube portion which is located in the storage box and that has an opening at an upper end of the vertical tube portion, such that the socket is bent at the end of the horizontal tube portion.

4. The unit device of claim 1, wherein the drain pan has a ventilating hole, wherein the ventilating hole communicates with the storage box via the communicating portion, and wherein the ventilating hole is located at a level that is higher than an operation water level at which a drain pump is allowed to suck drain water and that is lower than an upper end of a wall portion of the drain pan.

5. The unit device of claim 1, wherein the drain pan includes a passage that extends to the storage box and communicates with the unit body and the storage box via the communicating portion.

6. The unit device of claim 1, wherein the unit body has a vent that communicates with an inner space of the unit body and an inner space of the storage box, and wherein the vent communicates with the storage box via the communicating portion.

7. The unit device of claim 1, wherein the unit device of the refrigeration cycle apparatus is an indoor unit of an air-conditioning apparatus, the indoor unit including a heat exchanger, a refrigerant pipe that allows the refrigerant to flow to the heat exchanger, and a fan configured to send air to the heat exchanger, and the heat exchanger, the refrigerant pipe and the fan are provided in the unit body.

8. The unit device of claim 7, which is a ceiling mounted type of indoor unit that is attached to a ceiling of a room.

9. The unit device of claim 3, wherein the upper end of the vertical tube portion is located at a level that is higher than an operation water level at which a drain pump is allowed to suck drain water and that is lower than an upper end portion of a wall portion of the drain pan.

10. The unit device of claim 1, wherein the storage box is located on a side of the unit body.

* * * * *